United States Patent [19]

Müller et al.

[11] Patent Number: 4,955,286

[45] Date of Patent: Sep. 11, 1990

[54] TURBULENCE OUTLET

[75] Inventors: Gottfried Müller; Paul Hipp, both of Kolbingen, Fed. Rep. of Germany

[73] Assignee: Schako Metallwarenfabrik Ferdinand Schad AG, Kobingen, Fed. Rep. of Germany

[21] Appl. No.: 364,176

[22] Filed: Jun. 12, 1989

[30] Foreign Application Priority Data

Jul. 1, 1988 [DE] Fed. Rep. of Germany ..... 3822283

[51] Int. Cl.[5] ..... F24F 13/068

[52] U.S. Cl. ..... 98/40.11; 98/40.12

[58] Field of Search ..... 98/40.01, 40.11, 40.12, 98/40.15, 40.17, 40.2, 40.22, 41.3

[56] References Cited

U.S. PATENT DOCUMENTS

| | | | |
|---|---|---|---|
| Re. 25,216 | 8/1962 | Kennedy | 98/40.11 |
| 2,672,087 | 3/1954 | Marr | 98/40.2 |
| 3,099,200 | 7/1963 | Harrison | 98/40.11 |

FOREIGN PATENT DOCUMENTS

| | | | |
|---|---|---|---|
| 2847017 | 11/1974 | Fed. Rep. of Germany | 98/40.11 |

*Primary Examiner*—Harold Joyce

*Attorney, Agent, or Firm*—Bachman & LaPointe

[57] ABSTRACT

In a turbulence outlet to be connected to a pipe connection of an air conduit having a turbulence plate (5) which exhibits slots (6) with inclined lamellae (7) or the like apertures, the turbulence plate (5) is to exhibit somewhat centrally at least one aperture (8) with which a closable outlet part (9) is associated.

9 Claims, 1 Drawing Sheet

TURBULENCE OUTLET

BACKGROUND OF THE INVENTION

The invention relates to a turbulence outlet to be connected to a pipe connection of an air conduit having a turbulence plate which exhibits slots with inclined lamellae or the like apertures.

A turbulence outlet of this kind, particularly as a ceiling turbulence outlet, is listed under type DDB in the Applicant's catalogue. This ceiling outlet is a turbulence outlet with a highly inductive action. It can be installed flush with the ceiling or freely suspended. Slots are formed into the turbulence plate of this outlet, said forming-in being effected in U-shaped configuration.

During stamping the outlined web is pressed inwards and left standing as an inclined lamella. This arrangement produces a large number of partial jets which have an optimum turbulence effect. This results in extremely good mixing of the air, the inflowing feed air becoming mixed with the room air very rapidly in both cases of cooling and heating. This results in a rapid decay of the temperature differences, no drafts being created when cooling air is introduced. In the case of heating, the inflowing warm air penetrates very rapidly into the occupied area and decays the temperature differences there. However, this turbulence outlet is subject to limitations in very high rooms.

The inventors adopted the object to improve a turbulence outlet of the above-stated type by making it applicable also to high rooms.

SUMMARY OF THE INVENTION

This object is achieved in that the turbulence plate exhibits somewhat centrally at least one aperture with which a closable outlet part is associated.

An activable projection outlet is produced in this way which is opened only when required, that is to say when a rapid mixing of the air is required to occur also in the lower area of rooms.

Preferably, only one central aperture is stamped out in the turbulence plate, the outlet part masking the aperture towards the interior of the turbulence outlet.

How the outlet part itself is conformed should be of secondary importance. It is preferably constructed slot valve fashion. For example, it may consist of two or more plates which exhibit apertures which can be brought into coincidence. Said plates are rotatable relative to each other about a common axis for this purpose. As a rule the one plate will be constructed stationary and the other rotatably.

How the rotation of the plates occurs is likewise of lesser importance. It may occur manually or through a corresponding adjusting element. The drive may be by motor, electric or pneumatic.

A lever linkage is preferably connected to the rotating plate; it is then in turn actuable by the adjusting element or manually. The adjusting element has a rotary shaft which is connected to a lever which in turn engages the plate through a thrust rod.

In the case of high temperature differences in the case of heating, and simultaneously in the case of an installation of great height, the outlet part is opened so that the corresponding warm air can exit concentrated in the center and be projected relatively far. It is then carried immediately into the occupied area. Cooling air can also be regulated very well by the apparatus according to the invention. The present invention therefore combines a known turbulence outlet with a long-range projection outlet.

The advantages of the turbulence effect clearly lie in the closely stamped individual slots. With the adjustable outlet part, for example, the feed air volume can be reduced to the desired degree and any desired penetration depth determined. The entire outlet is loaded optimally by the nozzle-like approach flow. A very good architectonic appearance can also be obtained with this outlet. The outlet fits excellently into present-day ceilings and structures.

BRIEF DESCRIPTION OF THE DRAWINGS

Further advantages, features and particulars of the invention will appear from the description given below of preferred exemplary embodiments and with reference to the drawing, in which.

DETAILED DESCRIPTION OF THE DRAWINGS

Figure 1:
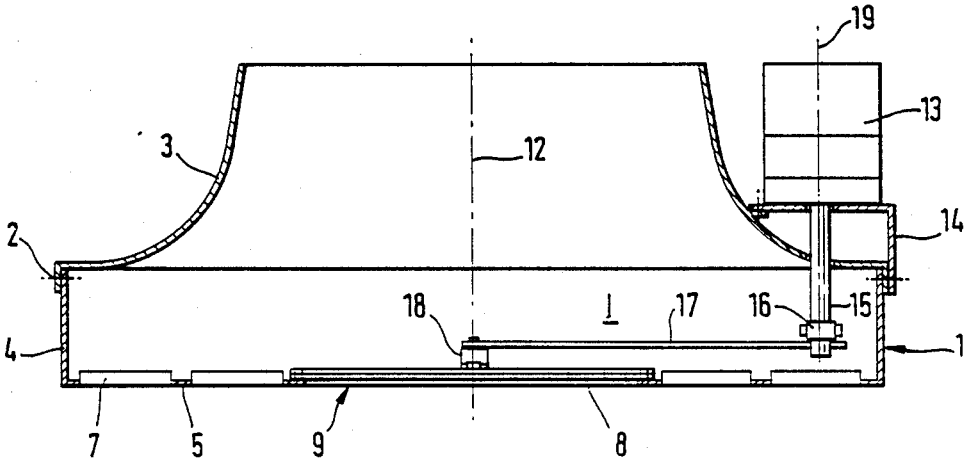
FIG. 1 shows a cross-section through a turbulence outlet according to the invention.

According to FIG. 1 a turbulence outlet 1 according to the invention is connected by corresponding fastening elements (screws) 2 to a cylindrical pipe connection 3 of an air conduit.

The turbulence outlet 1 has a cylindrical side wall 4 and a turbulence plate 5. A plurality of rows of slots 6 are stamped into the turbulence plate 5. The formed-in region of each slot 6 is left standing as a lamella 7 which generates the turbulence. Said relatively small stampings produce a large number of partial jets which have an optimum turbulence effect upon the airstream to be delivered and achieve very good mixing of the air. Consequently the inflowing feed air mixes with the room air very rapidly and the temperature differences decay very rapidly, whether in the case of cooling or of heating.

The drafts which are possible in the case of cooling are avoided, whereas in the case of heating the inflowing warm air penetrates very rapidly into the occupied area by the very rapid decay of the temperature differences.

Figure 2:
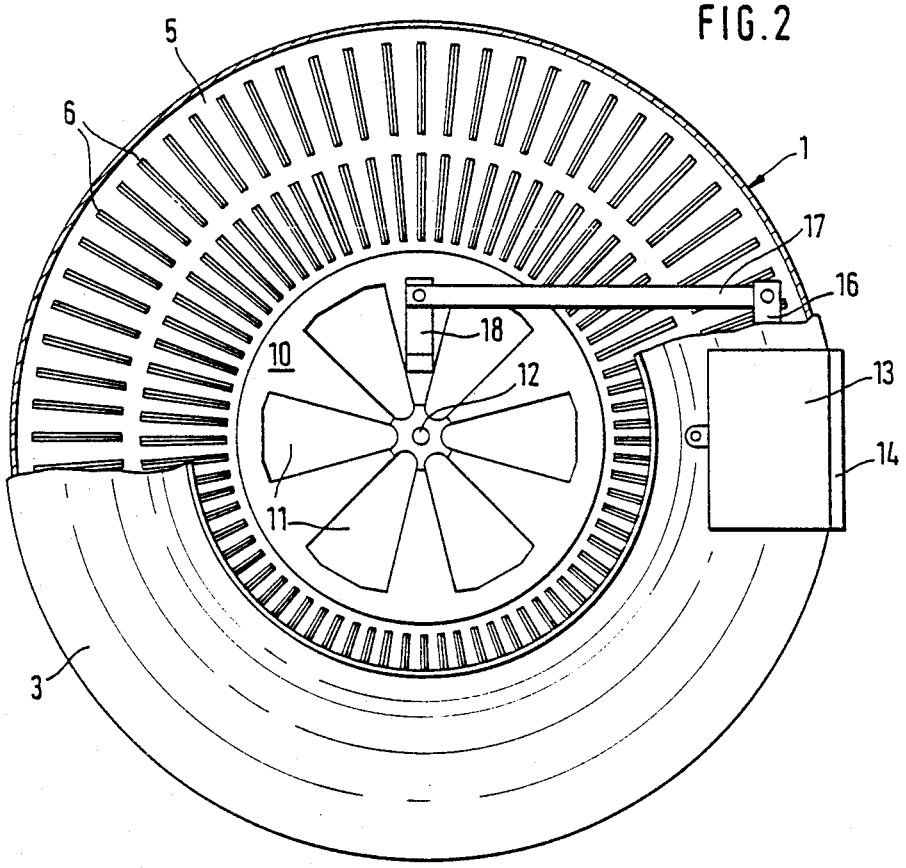
FIG. 2 shows a partly fragmented plan view of the turbulence outlet according to the invention according to FIG. 1 with a cylindrical pipe connection.

A circular aperture 8, which is stamped somewhat centrally into said turbulence plate 5, is masked by a closable outlet part 9. Said outlet part 9 resembles a slot valve and comprises two or more superposed plates with generally radial slot-shaped apertures. Only the uppermost plate 10 with corresponding apertures 11 is shown in FIG. 2.

In the present exemplary embodiment the plate 10 is rotatable about the axis 12 relative to the plates of the outlet part 9 located beneath it. Obviously, another plate of the outlet part 9 could also be rotatable relative to the top plate 10, for example. All such variations are embraced by the idea of the invention. The position of the apertures 11 in relation to the apertures of the plates below is modified by the rotatability of the plate 10, so that the overall outlet width and therefore the discharged airstream can be regulated. In the case of high temperature differences in the case of heating, and simultaneously in the case of an installation at a relatively great room height, the aperture 11 is brought into the utmost coincidence with the aperture below it, so that the warm air is discharged concentrated in the center. It is carried immediately into the occupied area. Likewise, the volume of feed air discharged vertically can also be regulated very well.

The rotation of the plate 10 about the axis 12 occurs through an adjusting element 13. The plate 10 can be rotated about the axis 12 by motor, electrically or pneumatically through said adjusting element 13, however it is also proposed to provide a manual rotatability.

In the present exemplary embodiment the adjusting element 13 is anchored on an angle 14. It engages by a rotary shaft 15 into the interior I of the turbulence outlet 1. A lever 16, which is connected to said rotary shaft 15, has at its other end an articulate connection to a thrust rod 17. Said thrust rod 17 in turn exhibits at its other end an articulate connection to a fastening angle 18 which is connected to the plate 10.

When the rotary shaft 15 is rotated about its axis 19, a pivoting of the lever 16 occurs, the thrust rod 17 being set into an approximately linear movement. This movement is transmitted by the thrust rod 17 through the fastening angle 18 to the plate 10, where the conversion into a rotary movement about the axis 12 occurs.

We claim:

1. Turbulence outlet to be connected to a pipe connection of an air conduit having a turbulence plate which has a plurality of slots formed with inclined lamellae on an edge of the slots wherein the turbulence plate exhibits somewhat centrally at least one aperture and closable means being associated with said one aperture.

2. Turbulence outlet as claimed in claim 1, wherein the aperture is stamped out.

3. Turbulence outlet as claimed in claim 1, wherein the closable means masks the aperture towards the interior of the turbulence outlet.

4. Turbulence outlet as claimed in claim 3, wherein the closable means comprises a closable plate having at least one aperture, said plate having means for rotation relative to said aperture of said turbulence plate about an axis such that when said aperture of said plates are non-aligned with said one aperture of said turbulence plate, the one aperture is closed and upon alignment of the aperture the aperture of said turbulence plate is open.

5. Turbulence outlet as claimed in claim 4, wherein the rotation of said closable plate occurs manually.

6. Turbulence outlet as claimed in claim 4, wherein an adjusting means is provided for the rotation of said closable plate.

7. Turbulence outlet as claimed in claim 6, wherein the adjusting means operates by motor, electrically or pneumatically.

8. Turbulence outlet as claimed in claim 7, wherein a lever linkage which is actuable by the adjusting means is connected to the closable plate.

9. Turbulence outlet as claimed in claim 8, wherein the adjusting means has a rotary shaft which is connected to a lever which engages the closable plate through a thrust rod.

* * * * *